US006433747B1

(12) United States Patent
Cumro et al.

(10) Patent No.: US 6,433,747 B1
(45) Date of Patent: Aug. 13, 2002

(54) INTEGRATED PIFA HAVING AN EMBEDDED CONNECTOR ON THE RADOME THEREOF

(75) Inventors: Gary A. Cumro, Alvo; Sripathi Yarasi, Lincoln; Govind R. Kadambi, Lincoln; Kenneth D. Simmons, Lincoln, all of NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 09/877,430

(22) Filed: Jun. 8, 2001

(51) Int. Cl.[7] ..... H01Q 1/38

(52) U.S. Cl. ..... 343/700 MS; 343/846; 343/872

(58) Field of Search ..... 343/700 MS, 702, 343/846, 848

(56) References Cited

U.S. PATENT DOCUMENTS

| | | | | |
|---|---|---|---|---|
| 5,270,722 A | * | 12/1993 | Delestre | 343/700 MS |
| 5,764,190 A | | 6/1998 | Murch et al. | 343/702 |
| 5,926,139 A | | 7/1999 | Korisch | 343/702 |
| 6,114,996 A | * | 9/2000 | Nghiem | 343/700 MS |
| 6,286,831 B1 | * | 9/2001 | Sanford | 343/702 |
| 6,295,030 B1 | * | 9/2001 | Kozakai et al. | 343/700 MS |
| 6,339,402 B1 | * | 1/2002 | McKivergan | 343/700 MS |

OTHER PUBLICATIONS

"Wireless Design On–line Newsletter", vol. 3, Issue 5, Nov. 22, 1999.

* cited by examiner

*Primary Examiner*—Tan Ho
(74) *Attorney, Agent, or Firm*—Thomte, Mazour & Niebergall; Dennis L. Thomte

(57) ABSTRACT

A Planar Inverted F Antenna (PIFA) is disclosed comprising a radiator assembly positioned in the interior of a lower Radome member. An upper Radome member is placed over the radiator assembly with the upper Radome member and the lower Radome member fully enclosing the radiator assembly. The radiator assembly is held to the upper and lower Radome members by means of three dielectric blocks on each member. The radiator assembly comprises: (1) two radiating elements placed on the opposite sides of common ground plane; (2) two separate shorting strips extending between one end of each radiating element and one end of common ground plane; (3) a common feed conductor in the form of a single strip connecting one edge of each radiating element and the common feed conductor which has a disc-shaped portion with an opening formed therein. A ground tab is formed as an extension of the common ground plane. A hollow cylindrical structure formed as an outward extension of the lower Radome member constitutes the embedded (built-in) connector for the PIFA. A metal rod is inserted through the opening in the disc-shaped portion and protrudes into the hollow cylindrical structure to serve as the feed (center) pin of the embedded connector. A cylindrical dielectric block on the bottom surface of the upper Radome member holds the feed (center) pin in the designed location of the embedded connector. The ground tab protrudes into the hollow cylindrical structure and maintains a flush contact with the side wall of the hollow cylindrical structure to provide the ground potential of the embedded connector.

18 Claims, 5 Drawing Sheets

INTEGRATED PIFA HAVING AN EMBEDDED CONNECTOR ON THE RADOME THEREOF

BACKGROUND OF THE INVENTION

1. Field of the Invention

The present invention relates to a Planar Inverted F Antenna (PIFA) and, in particular, to an integrated composite design of a PIFA having an embedded or built-in plastic connector on the Radome surface of the PIFA.

2. Description of the Related Art

With the rapid progress in wireless communication technology and the ever-increasing emphasis for its expansion, wireless modems on laptop computers and other handheld radio devices will be a common. feature. The technology employing a short-range radio link to connect devices such as cellular handsets, laptop computers, and other handheld devices has already been demonstrated [Wireless Design On-line Newsletter, Vol. 3, Issue 5, Nov. 22, 1999]. The performance of the antenna placed on devices like handsets and laptop computers is one of the critical parameters for the satisfactory operation of such a radio link. Therefore, the performance characteristics of the antenna utilized on communication devices assume significant importance in the evolving technology of wireless modems.

In the cellular communication industry, there recently has been an increasing emphasis on internal antennas instead of conventional external wire antennas. The concept of an internal antenna stems from the avoidance of a protruding external radiating element by the integration of the antenna into the device itself. Internal antennas have several advantageous features such as being less prone to external damage, a reduction in overall size of the handset with optimization, and ease of portability. The printed circuit board of the communication device serves as the ground plane of the internal antenna. Among the various choices for internal antennas, PIFA appears to have great promise. The PIFA is characterized by many distinguishing properties such as relative light weight, ease of adaptation and integration into the device chassis, moderate range of bandwidth, Omni directional radiation patterns in orthogonal principal planes for vertical polarization, versatility for optimization, and multiple potential approaches for size reduction. The PIFA also finds useful applications in diversity schemes. The sensitivity of the PIFA to both vertical and horizontal polarization is of immense practical importance in mobile cellular/RF data communication applications because of the absence of the fixed antenna orientation as well as the multi-path propagation conditions. The features enumerated above render the PIFA to be a good choice as an internal antenna for mobile cellular/RF data communication applications.

A conventional prior art single band PIFA assembly with an external RF connector is illustrated in FIGS. 5A and 5B. The PIFA 100 shown in FIGS. 5A and 5B consists of a radiating element 101, a ground plane 102, a connector feed pin 104*a*, and a conductive post or pin 107. A power feed hole 103 is formed in the radiating element 101 which receives the connector feed pin 104*a*. The connector feed pin 104*a* serves as a feed path for radio frequency (RF) power to the radiating element 101. The connector feed pin 104*a* is inserted through the feed hole 103 from the bottom surface of the ground plane 102 and is electrically insulated from the ground plane 102 where the pin passes through the hole in the ground plane 102. The connector feed pin 104*a* is electrically connected to the radiating element 101 at 105*a* with solder. The body of the feed connector 104*b* is electrically connected to the ground plane at 105*b* with solder. The connector feed pin 104*a* is electrically insulated from the body of the feed connector 104*b*. A through hole 106 is formed in radiating element 101 and a conductive post or pin 107 is inserted through the hole 106. The conductive post 107 serves as a short-circuit-between the radiating element 101 and the ground plane 102. The conductive post 107 is electrically connected to the radiating element 101 at 108*a*with solder. The conductive post 107 is also electrically connected to the ground plane 102 at 108*b* with solder. The resonant frequency of the PIFA 100 is determined by the length (L) and width (W) of the radiating element 101 and is slightly affected by the locations of the feed pin 104*a* and the shorting pin 107. The impedance match of the PIFA 100 is achieved by adjusting the diameter of the connector feed pin 104*a*, by adjusting the diameter of the conductive shorting post 107, and by adjusting the separation distance between the connector feed pin 104*a* and the conductive shorting post 107.

In the prior art techniques of PIFA design (Murch R. D., et al., U.S. Pat. No. 5,764,190; Korisch I. A., U.S. Pat. No. 5,926,139) the center conductor of the coaxial cable from the RF source is directly connected to the radiating element of the PIFA at the feed point. Further, in these designs, the feed point of the PIFA is drawn away from the shorted edge of the radiating element and is located within the central surface of the radiating element. Therefore, the feed cable from the RF source has to pass through the interior region (between the radiating element and the ground plane) of the PIFA. Such a prior art feeding scheme of the PIFA will prove to be tedious and cumbersome in the final integration process. An alternative scheme of a PIFA design that circumvents such a tedious feed assembly is therefore desirable. From the structural and fabrication point of view, an avoidance of a feed cable extending through the interior region of the PIFA is preferred. One recourse to accomplish the above task is to terminate the feed point of the PIFA with an external RF connector as explained in the description of a conventional PIFA. In most of the PIFA designs having an external RF connector, the cost of the commercial RF connector is in excess of the cost of the PIFA itself. An innovative design concept of a PIFA circumventing the requirement of an external RF connector for its operation is therefore a significant important feature to realize an enhanced cost-effectiveness of the PIFA technology. Keeping in pace with the rapid miniaturization in the size of the mobile voice and RF data communication devices, the future design of internal antenna should be accomplished without necessitating any change in the overall size of the communication device. The system considerations often warrant placement of the internal antenna at different locations on the device chassis with a very small volume earmarked for it. At times, the ground plane of the internal antenna might be in isolation with the chassis of the radio device resulting in a very small ground plane for the antenna. Under such design restrictions, the internal antenna has to exhibit satisfactory gain and bandwidth performance despite the non-availability of a large ground plane. Therefore, the design concept of an internal antenna such as a PIFA with a very small ground plane which overcomes the existing shortcomings of the PIFA feed structure is highly desirable for wireless applications to facilitate the ease of antenna integration, compactness, and adaptation.

The principal objective of this invention is to provide an encapsulated PIFA module which circumvents the requirement of attachment of a separate and an external RF connector to the feed point of the PIFA.

A further objective of this invention is to provide a design of a PIFA configuration which is devoid of an external metal RF connector.

A further objective of this invention is to provide a PIFA having a very small ground plane so that final PIFA module is compact and miniaturized in size.

Still another objective of this invention is to provide a design configuration of the composite assembly of a PIFA, its Radome and a RF connector for feeding the PIFA as an integrated module.

Still another objective of this invention is provide a structural configuration of a PIFA which is devoid of a feed assembly which passes through the interior region of the PIFA.

Yet another objective of this invention is to provide a composite assembly of a PIFA, its Radome, and a built-in connector which is cost effective to fabricate.

Still another objective of this invention is to provide a PIFA module which is easy for final system integration.

These and other objects will be apparent to those skilled in the art.

SUMMARY OF THE INVENTION

The instant invention provides a composite structure of a radiator assembly, a Radome, and an RF connector of a PIFA as an integrated single module. The PIFA of this invention overcomes the need of a separate external RF connector for the PIFA. In the preferred embodiment, the connection of the PIFA to the RF source of the system is through a simple, built-in, or embedded plastic connector which is a part of the Radome of the PIFA. A hollow cylindrical structure formed as an outward extension of the Radome serves as the embedded plastic connector of the PIFA. A metal rod attached to the feed conductor of the PIFA which protrudes into the hollow cylindrical structure of the Radome forms the center pin of the embedded plastic connector of the PIFA. A tab attached to the common ground plane which extends into the hollow cylindrical structure of the Radome provides the ground potential of the embedded plastic connector. The concept of dual radiating elements with a common ground plane and a common feed conductor is also disclosed to achieve the satisfactory performance of the PIFA despite a very small ground plane.

DESCRIPTION OF THE PREFERRED EMBODIMENTS

Figure 1:
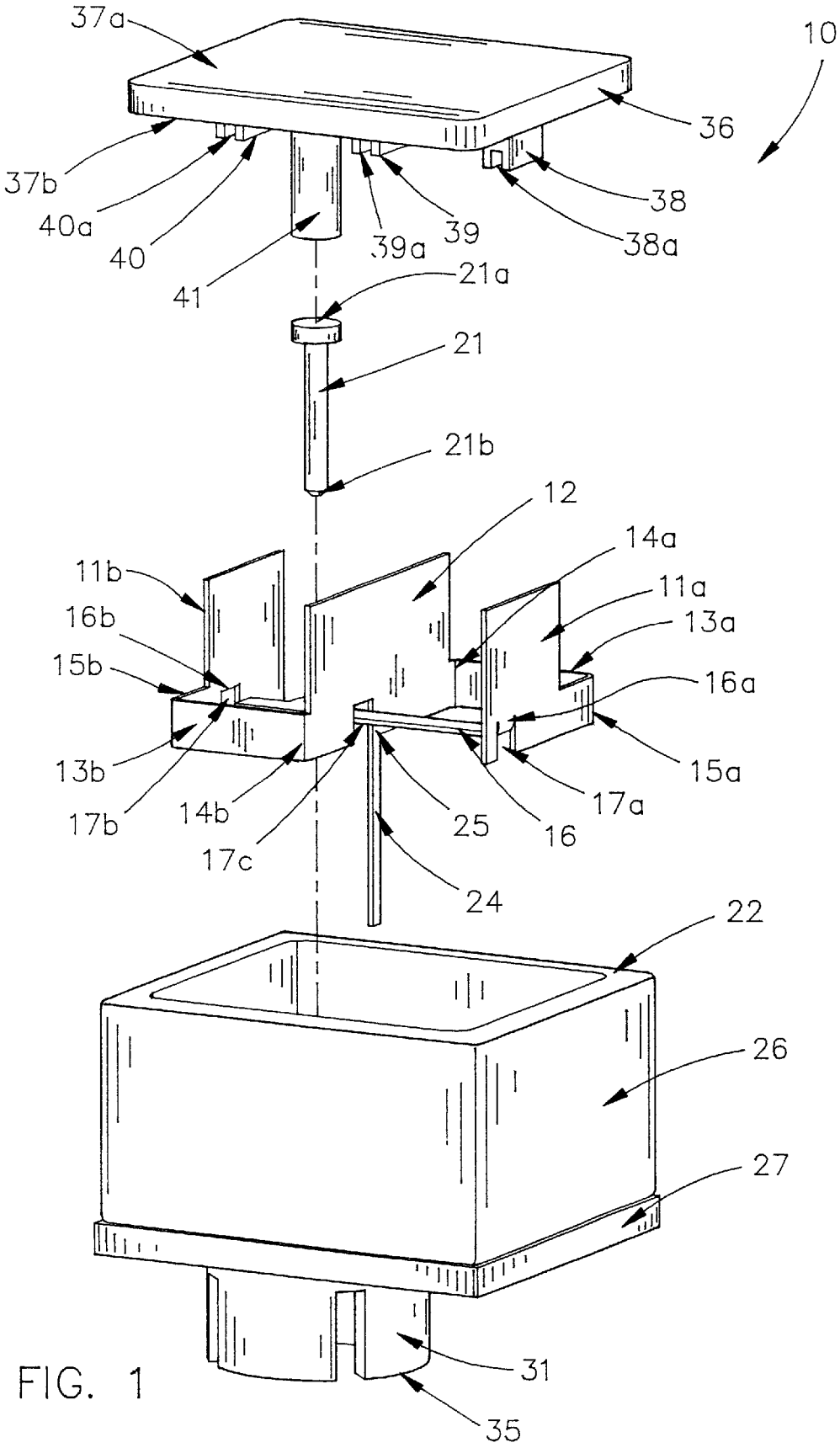
FIG. 1 is a partial exploded perspective view of the antenna of this invention.

Preferred embodiments of the present invention are now explained while referring to the drawings.

In the accompanying text describing the single band PIFA module 10 with an embedded (built-in) plastic connector of SMA male type covered under the embodiment of this invention, refer to FIGS. 1, 2, and 3. Generally speaking, the PIFA 10 comprises a radiator assembly placed inside a Radome. The Radome consists of a top cover and a bottom cover with side walls. A hollow cylindrical plastic structure formed as an extension of the bottom cover of the Radome constitutes the embedded (built-in) connector of this invention. The top cover of the Radome, when placed over the open surface of the bottom cover of the Radome, completely encloses the radiator assembly.

The radiator assembly has two identical radiators 11*a* and 11*b* placed on the opposite sides of a common ground plane 12. A metallic strip 13*a* serves as a short-circuiting element between the first radiating element 11*a* and the common ground plane 12. The short-circuiting strip 13*a* is connected to the ground plane 12 at 14*a*. The short-circuiting strip 13*a* is also connected to the radiating element 11*a* at 15*a*. Another metallic strip 13*b* serves as a short-circuiting element between the second radiating element 11*b* and the common ground plane 12. The short-circuiting strip 13*b* is connected to the ground plane 12 at 14*b*. The short-circuiting strip 13*b* is also connected to the radiating element 11*b* at 15*b*. A metallic strip 16 serves as a common feed conductor to both the radiating elements 11*a* and 11*b*. The feed conductor 16 is formed as an integral part of the radiating element 11*a*. Below the conjecture point 16*a* of the feed conductor 16 and the radiating element 11*a*, there is a small notch 17*a* on the radiating element 11*a* through which the feed conductor 16 is drawn towards the ground plane 12. The feed conductor 16 passes through a notch 17*c* on the ground plane 12. The size and the location of the notch 17*c* are such that the feed conductor 16 will not touch the ground plane 12. The feed conductor 16 is then drawn through a notch 17*b* on the radiating element 11*b*. The feed conductor 16 is then attached to the second radiating element 11*b* at 16*b* by solder. The notches 17*a*, 17*b*, and 17*c* are aligned along a straight line with a common horizontal axis.

Figures 2A, 2B, 2C:
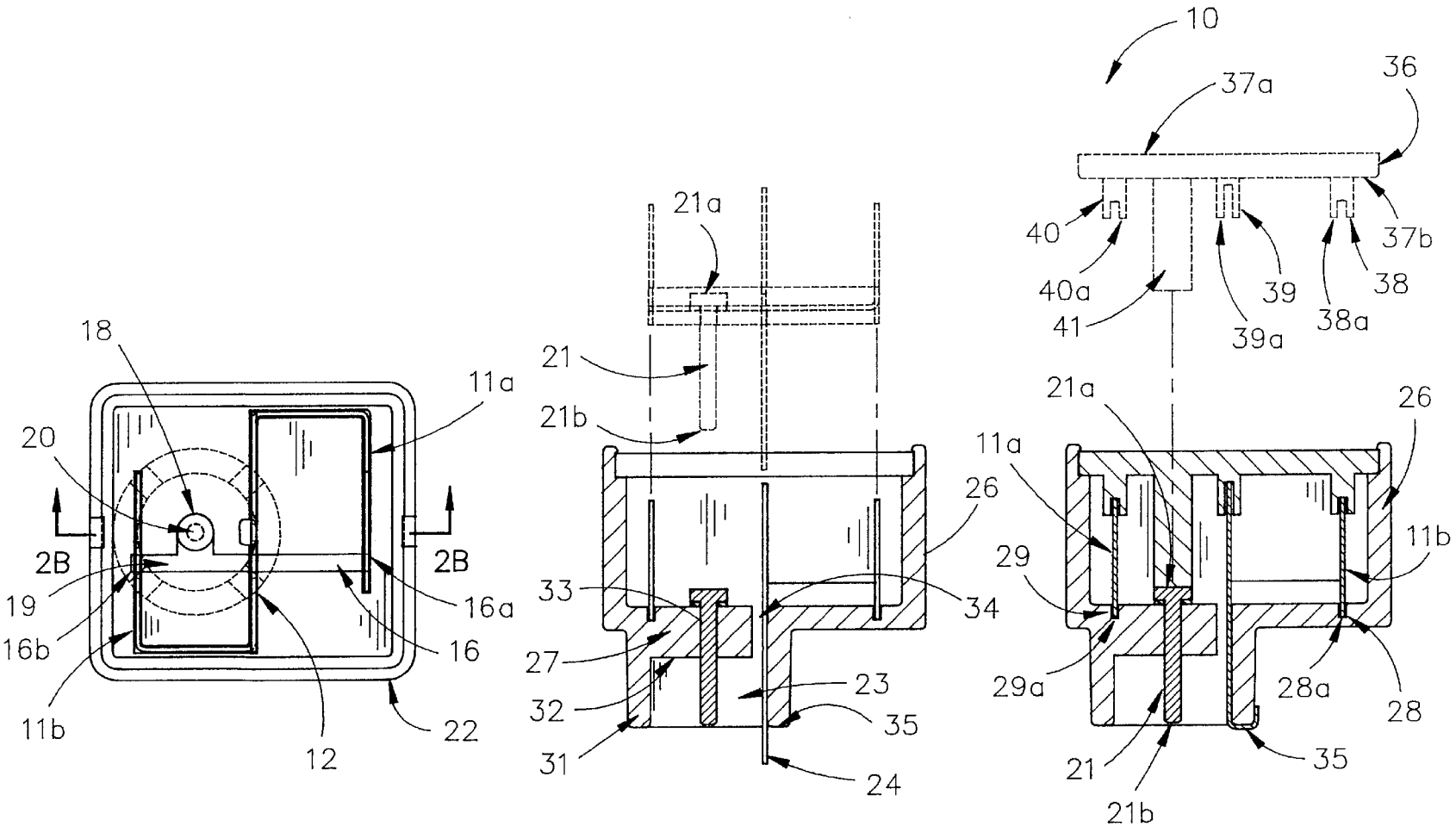
FIG. 2A is a top view of the antenna of this invention having the top Radome cover removed therefrom.
FIG. 2B is a sectional view along line B—B of FIG. 2A.
FIG. 2C is a sectional view along line B—B of FIG. 2A with the top Radome cover.

A small circular disc 18 is also a part of the feed conductor 16 (FIG. 2A). The circular disc 18 and the feed conductor 16 have a common overlapping area 19. There is a small hole 20 at the center of the circular disc 18. The diameter of the hole 20 is equal to the diameter of the center element of standard RF male SMA connector. The metallic rod 21, while serving as a PIFA feed contact for the RF source, also forms the center conductor (pin) of the proposed (built-in) embedded plastic connector 23 of this invention. At the upper end 21*a*, the diameter of the feed pin 21 is larger than the diameter of the hole 20 thus allowing only the lower end 21*b* of the feed pin 21 to slide through the hole 20 on the disc 18 of the feed conductor 16. From the top of the disc 18 of the feed conductor 16, the feed pin 21 is inserted through the hole 20 (FIG. 2A). The upper end 21*a* of the feed pin 21 makes a flush contact with the disc 18. The free end 21*b* of the feed pin 21 which is inserted through the hole 20 on the disc 18 of the feed conductor 16 is allowed to pass through vertically down through the hole 33 on the base 27 of the bottom Radome cover 22.

A metallic strip 24 of narrow width runs parallel to the feed pin 21 and is connected to the ground plane 12 at 25. The open end of the metallic strip 24 is free to pass through the designated hole 34 on the base 27 of the bottom Radome cover 22. The metallic strip 24, which effectively is an extension of the ground plane, provides a ground potential to the embedded plastic connector 23. Therefore, the metallic strip 24 performs the role similar to that of a metallic body of a conventional RF connector in providing the ground potential.

Figure 3A:
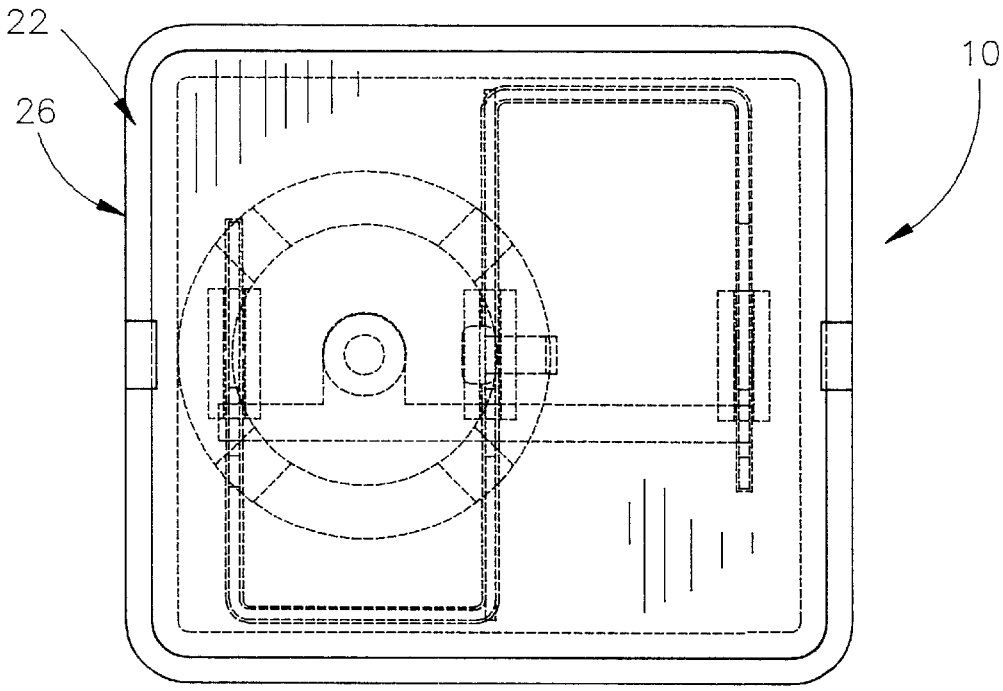
FIG. 3A is a top view of the antenna of this invention with the top Radome cover.
Figure 3B:
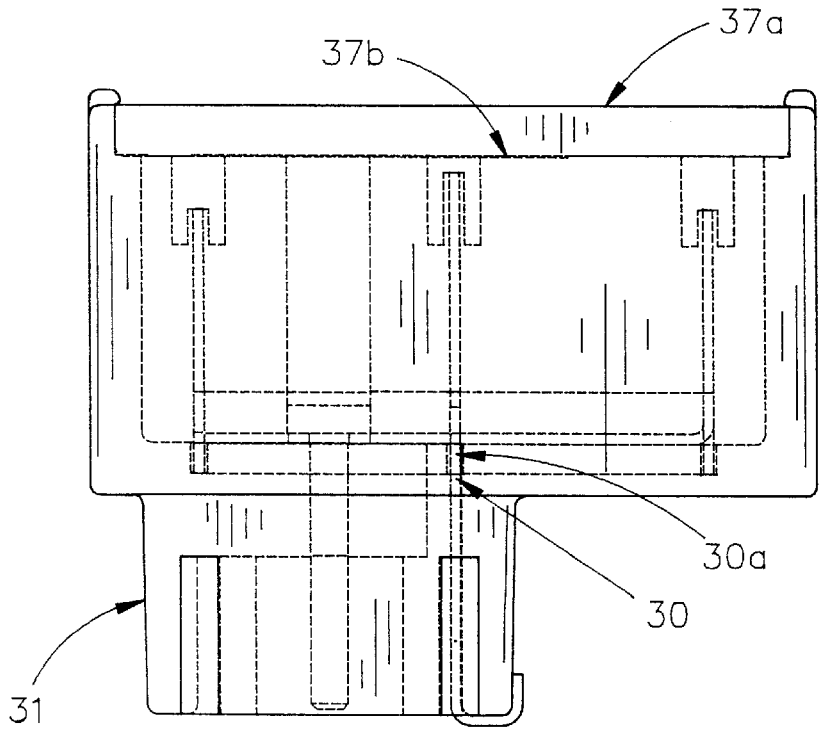
FIG. 3B is a partial sectional view of FIG. 3A.

The bottom Radome cover 22 serves the multiple functions of holding the radiator assembly (comprising the radiating elements 11*a* and 11*b*, the ground plane 12, the shorting strips 13*a* and 13*b*, and the feed conductor 16) in the desired location and also provides the base 32 for embedded (built-in) plastic connector 23. The bottom Radome cover 22 is nearly a square in shape with the top surface open. The bottom Radome cover 22 has side walls 26 and a base 27. The bottom Radome cover 22 has three small dielectric blocks 28, 29, and 30. The plastic block 28 has a notch 28*a* along its central axis (FIG. 2C). Likewise, the notch 29*a* is along the central axis of the block 29. The notch 30*a* runs along the central axis of the block 30. The radiating element 11*a* is held to the bottom Radome cover 22 through the notch 28*a* (FIG. 2C). The radiating element 11*b* and the bottom Radome cover 22 are held in the desired position through the notch 29*a*. The notch 30*a* holds the ground plane 12 and the bottom Radome cover 22 in the intended position (FIG. 3B).

The embedded (built-in) plastic connector 23 is an outward extension of the bottom Radome cover 22. The embedded plastic connector 23 is a hollow cylindrical structure with a side wall 31. The side wall 31 has longitudinal perforations (perforations parallel to the axis of the hollow cylinder). The inner diameter of the hollow cylindrical structure is chosen to allow the easy passage of the mating RF connector into the plastic connector 23. The height of the side wall 31 is chosen to ensure that the mating RF connector rests on the base 32 of the plastic connector 23. The hole 33 on the base 27 of the bottom Radome cover 22 is for the insertion of the feed pin 21 into the hollow cylindrical area of the plastic connector 23. The center of the hole 33 coincides with the center of the hollow cylinder of the plastic connector 23. Also, the center of the hole 20 on the disc 18 of the feed conductor 16 and the center of the hole 33 lie along a common vertical axis. At the upper end 21*a*, the diameter of the feed pin 21 is larger than the diameter of the hole 20 thus allowing only the lower end 21*b* of the feed pin 21 to slide through the hole 20 on the disc 20 of the feed conductor 16. From the top of the disc 18 of the feed conductor 16, the feed pin 21 is inserted through the hole 20 (FIG. 2B). The upper end 21*a* of the feed pin 21 makes a flush contact with surface of the disc 18. The free end 21*b* of the feed pin 21 which passes through the hole 20 on the disc 18 of the feed conductor 16 is allowed to pass through vertically down through the hole 33 on the base 27 of bottom Radome cover 22. The free end 21*b* of the feed pin 21 is positioned always to be well within the height of the side wall 31 of the plastic connector 23 and is designed to establish a consistent electrical contact with the center element of the mating connector. Electrically, the feed pin 21 located within the hollow cylindrical structure of the plastic connector 23 performs an identical role of a center pin (element) of a conventional RF SMA male connector. By establishing a consistent electrical contact with the center conductor of the mating RF female connector, the feed pin 21 connects the feed conductor 16 of the radiating elements 11*a* and 11*b* of the PIFA to the RF source of the radio device.

In a conventional RF SMA male or female connector, the metallic body of the connector offers the ground potential. In the design of embedded plastic connector 23 of this invention, the plastic side wall 31 of the plastic connector 23 replaces the metal body of a conventional RF SMA connector. Therefore, for the functioning of the embedded plastic connector 23 built on the bottom Radome cover 22 of the PIFA 10, recourse is needed to provide a ground potential. From an RF point of view, the desired ground potential for the embedded plastic connector 23 is offered by the ground tab 24 of the ground plane 12. The ground tab 24, which is an attachment to the ground plane 12 of the PIFA at 25, is inserted vertically down through the hole 34 on the bottom Radome cover 22 (FIG. 2B). The ground tab 24 is then allowed to maintain a flush contact with the interior surface of the side wall 31 of the plastic connector 23. The ground tab 24, after running through the full length of the hollow cylindrical structure of the plastic connector 23, is bent flush at the protruding edge 35 of the side wall 31 (FIGS. 2B and 2C). The ground tab 24 is again bent down retaining the flush contact with the exterior surface of the side wall 31. When the mating RF female connector is inserted into the hollow cylindrical area of the embedded (built-in) SMA male plastic connector 23, the ground tab 24 is in firm electrical contact with the body of the RF female connector and hence the ground tab 24 offers the desired ground potential. In essence, the non-feasibility of providing the ground potential in lieu of the non-metallic body of the embedded plastic connector 23 is overcome through an innovative design of the ground tab 24 maintaining a flush contact with the side wall 31 of the plastic connector 23.

The top Radome cover 36 has a flat outer surface 37*a* and an inner surface 37*b* (FIG. 2C). Attached to the inner surface 37*b* of the top Radome cover 36 are the three dielectric blocks 38, 39, and 40 of rectangular shape. The notch 38*a* is along one of the central axis of the plastic block 38. Similarly, the notch 39*a* is along one of the central axis of the plastic block 39. Likewise, the notch 40*a* is along one of the central axis of the plastic block 40. When the top Radome cover 36 is placed on the open surface of the bottom Radome cover 22 (FIG. 2C), the radiating element 11*a* is held to the top Radome cover 36 through the notch 38*a*, the radiating element 11*b* and the top Radome cover 36 are held in desired position through the notch 40*a*, and the notch 39*a* holds the ground plane 12 and the top Radome cover 36 in desired position. The dielectric block 41 of cylindrical shape is also attached to the inner surface 37*b* of the top Radome cover 36 (FIG. 2C). The center of the dielectric cylindrical block 41 and the center of the hole 20 on the disc 18 of the feed conductor 16 lie along a common vertical axis. The length of the cylindrical block 41 is designed such that when the top Radome cover 36 is placed over the open surface of the bottom Radome cover 22, the free end of the dielectric block 41 pushes the upper end 21*a* of the feed pin 21 to make a flush contact with the surface of the disc 18 attached to the feed conductor 16 (FIG. 2C). Through such a design, the dielectric cylindrical block 41 holds the feed pin 21 in the desired position, as shown in FIG. 2C.

The significant steps for assembling the different parts of the composite structure of the PIFA 10 with an embedded plastic connector 23 formed on the bottom Radome cover 22 of the PIFA are as follows. In the first step, the radiator assembly comprising the radiating elements (11*a* and 11*b*), the ground plane 12, the shorting strips (13*a* and 13*b*), the common feed conductor 16 (formed as an extension of the radiating element 11*a*) including the disc 18, and the ground tab 24 are formed as a single unit by the continuous and sequential bending of a metallic sheet of appropriate size and shape. In the second step, the open end of the feed conductor 16 is soldered to the radiating element 11*b* at 16*b*. In the third step, with the upper end 21*a* of the feed pin 21 making a flush contact with the surface of the disc 18, the open end 21*b* of the feed pin 21 is drawn vertically down through the hole 20 on the disc 18 (FIG. 2B). In the fourth step, the complete radiator assembly including the feed pin 21 is placed inside the bottom Radome cover 22 of the PIFA. The surfaces of the radiating elements (11*a* and 11*b*) and the ground plane 12 are held parallel to the side wall 26 of the bottom Radome cover 22 (FIGS. 2A and 3A). The notch 28*a* holds the radiating element 11*a* to the bottom Radome cover 22. Similarly, the notch 29*a* holds the radiating element 11*b* to the bottom Radome cover 22. Likewise, the ground plane 12 is held to the bottom Radome cover 22 through the notch 30*a* (FIG. 3B). The open end 21*b* of the feed pin 21 from the radiator assembly is drawn through the hole 33 on the base 27 of the bottom Radome cover 22. After passing through the base 27 of the bottom Radome cover 22, the open end 21*b* of the feed pin 21 is then confined to lie within the hollow cylindrical area of the plastic connector 23. The open end of the ground tab 24 is then drawn through the hole 34 on the bottom Radome cover 22. The ground tab 24 is then allowed to maintain a flush contact with the interior surface of the side wall 31 of the plastic connector 23. The ground tab 24, after passing through the full length of the side wall 31 of the hollow cylindrical structure of the plastic connector 23, is bent flush at the protruding edge 35 of the side wall 31. The ground tab 24 is then again bent down retaining the flush contact with the exterior surface of the side wall 31 (FIGS. 2B and 2C). In the final step, the top Radome cover 36 is placed over the open surface of the bottom Radome cover 22 (FIG. 2C). In this step, the radiating element 11*a* is held to the top cover 36 through the notch 38*a*. Likewise, the radiating element 11*b* is held to the top cover 36 through the notch 40*a*. Similarly, the notch 39*a* holds the ground plane 12 to the top cover 36. The dielectric block 41 pushes the upper end 21*a* of the feed pin 21 to maintain a firm and consistent flush contact with the disc 18 on the feed conductor 16 (FIG. 2B). With this step, the assembly of the PIFA module with an embedded (built-in) plastic connector on the Radome is complete.

The above description of the composite assembly of a PIFA With an embedded (built-in) plastic connector 23 applies specifically to SMA male type. Without loss of generality, the concept described above for the embedded plastic connector 23 of SMA male type can be extended to the embedded connector of SMA female type also. The only change involved pertains to the feed pin 21. For the embedded plastic connector of SMA female type, the feed pin 21 must be a hollow metal tube instead of a solid metal rod. The diameter of the hollow metal tube is chosen appropriately to maintain a firm contact with the center element (pin) of the mating SMA male connector.

The composite assembly of a PIFA 10 with an embedded (built-in) plastic connector described under the embodiment of this invention functions as a single band PIFA. The resonant frequency of the PIFA 10 is determined by the linear dimensions of the radiating elements 11*a* and 11*b*, the height of the PIFA radiating elements 11*a* and 11*b* (the distance between the ground plane 12 and the radiating elements 11*a* and 11*b*), the dimensions of the Radome covers 22 and 36, and the dielectric constant of the material of the Radome. The bandwidth of the PIFA 10 is determined by the linear dimensions of the radiating elements 11*a* and 11*b*, the height of the radiating elements 11*a* and 11*b*, the width of the short-circuiting strips 13*a* and 13*b*, the position of the common feed conductor 16, and the dielectric loss property of the material of the Radome. To retain the satisfactory pattern performance despite a very small ground plane 12, two radiating elements 11*a* and 11*b* have been utilized to design a single band PIFA 10. It is pertinent to point out that the two radiating elements 11*a* and 11*b* are having a common feed conductor 16. Without loss of generality, the concept of embedded plastic connector of this invention can easily be extended to a PIFA with a single radiating element also. Further, the suggested design of an embedded plastic connector can be extended to the case of multi band PIFA operation also. In addition, the design concept proposed in this invention can be applied to other types of embedded plastic connectors such as TNC (male or female type).

Figure 4:
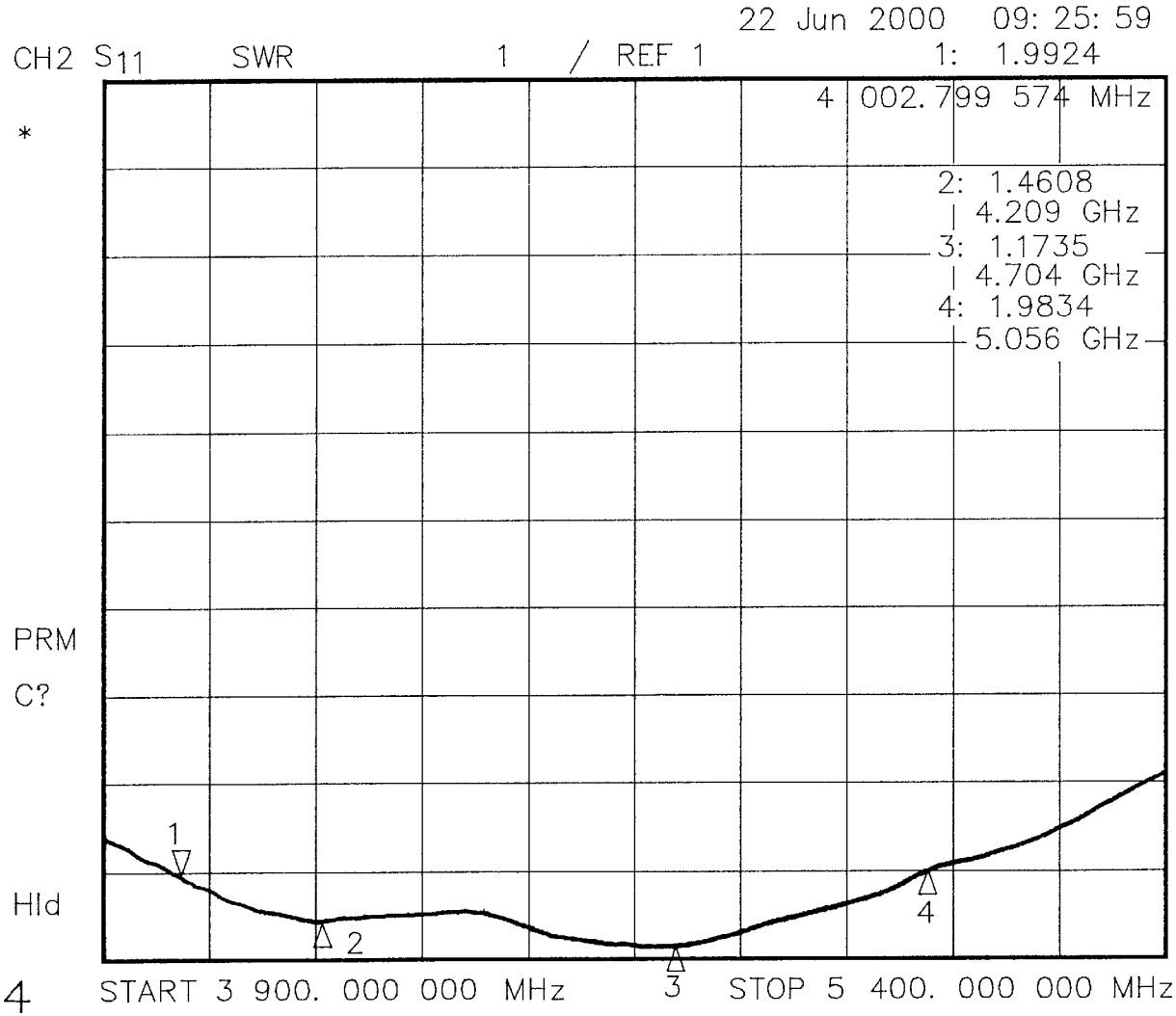
FIG. 4 is a frequency response chart which depicts the characteristics of the VSWR of the single band PIFA of FIG. 1.
Figure 5A:
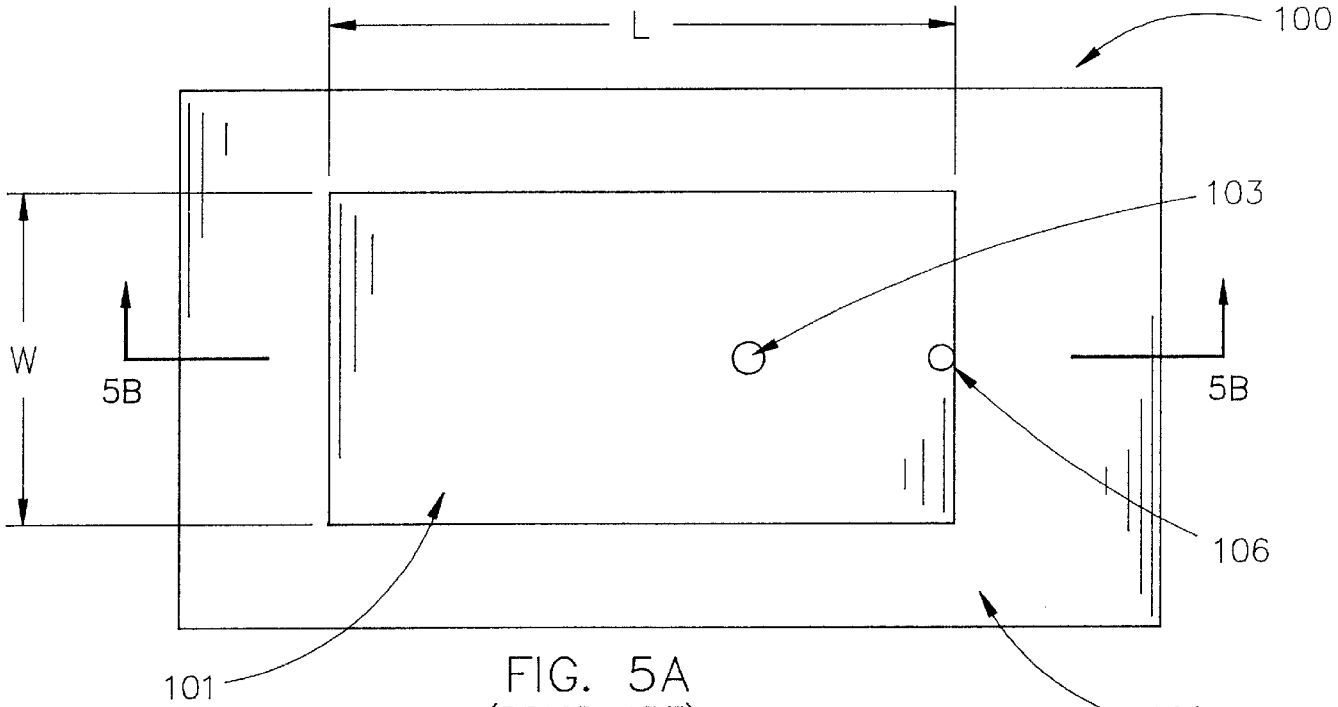
FIG. 5A (PRIOR ART)
FIG. 5A is. a top view of a prior art single band PIFA.
Figure 5B:
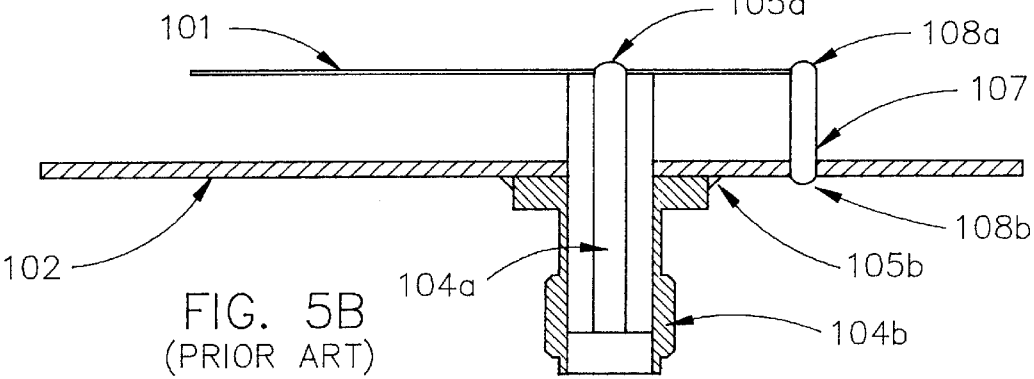
FIG. 5B (PRIOR ART)
FIG. 5B is a sectional view taken along the line 5—5 of FIG. 5A.

Based on the description covered under the embodiment of this invention, a single band PIFA with an embedded plastic SMA male connector on the Radome of the PIFA 10 has been designed and fabricated. The semi perimeter (sum of the length and width) of the radiating elements 11*a* and 11*b* of the PIFA is 14.5 mm. The width of the ground plane is 7.5 mm and the length of the ground plane is 13 mm. The result of the test conducted on the PIFA module 10 is illustrated in FIG. 4. FIG. 4 depicts the VSWR characteristics of the PIFA 10. A good bandwidth performance of the PIFA 10 is apparent from the results shown in FIG. 4.

As can be seen from the foregoing discussions, a novel scheme to design a single band PIFA with an embedded plastic connector on the Radome of the PIFA has been proposed and demonstrated. The proposed PIFA design overcomes the need of a separate external RF connector for the PIFA operation. The concept of embedded plastic connector reduces the weight and cost of the PIFA. The suggested design of the PIFA in a modular form has the distinct advantage and the desirable feature of easy and much simplified integration to the device chassis. In the PIFA design of this invention, the feed assembly is confined only to the exterior of the module resulting in enhanced fabrication ease. The proposed scheme also overcomes the tedious feed assembly of the prior art techniques of the PIFA design. The radiating elements, the shorting strips, the feed conductor, and the ground plane of the PIFA 10 are so configured to facilitate the formation of the radiator assembly of a PIFA in one process of continuos and sequential bending of a single sheet of metal resulting in improved manufacturability. The concept of dual radiating elements with a common ground plane and feed conductor has also been invoked in this invention to achieve the satisfactory pattern performance of the PIFA 10 despite a very small ground plane. The encapsulated single band PIFA 10 with an embedded plastic connector of this invention is lightweight, compact, cost-effective, and easy to manufacture.

Thus, the novel technique of an integrated composite design of a PIFA and an embedded plastic connector on the Radome surface of the PIFA of this invention has accomplished at least all of its stated objectives.

We claim:

1. A Planar Inverted F Antenna (PIFA), comprising:

a common ground plane having opposite sides;

a first radiating element positioned at one side of said common ground plane;

a second radiating element positioned at the other side of said common ground plane;

said first and second radiating elements being identical;

each of said first and second radiating elements having a short-circuiting strip which is connected to said common ground plane.

2. The PIFA of claim 1 wherein a common feed conductor is attached to said first and second radiating elements.

3. The PIFA of claim 2 wherein said common feed conductor includes a disc-shaped portion having an opening formed therein; a feed pin extending through said opening in said disc-shaped portion of said common feed conductor; said feed pin functioning as an analogous center pin of a SMA male connector.

4. The PIFA of claim 3 wherein said feed pin has an enlarged head portion which is in engagement with said disc-shaped portion around said opening formed therein.

5. The PIFA of claim 4 wherein a ground tab extends from said common ground plane so as to serve as the metal body of a SMA connector.

6. The PIFA of claim 5 wherein said ground tab is disposed parallel to said feed pin.

7. The PIFA of claim 6 wherein said first and second radiating elements, said common ground plane, said short-circuiting strips, said common feed conductor, said disc-shaped portion, and said ground tab are of integral one-piece construction.

8. The PIFA of claim 6 wherein said first and second radiating elements, said common ground plane, said common feed conductor, and said ground tab are enclosed within a radome.

9. The PIFA of claim 8 wherein said radome comprises upper and lower radome members; said lower radome member including a base having upstanding walls which defines a compartment, said upper radome member being positioned on said side walls to close said compartment.

10. The PIFA of claim 9 wherein said upper radome member has dielectric blocks extending therefrom for maintaining said radiating elements and said common ground plane in position.

11. The PIFA of claim 10 wherein a dielectric block extends from said upper radome member for engagement with said feed pin to ensure that said feed pin is maintained in contact with said disc-shaped portion.

12. The PIFA of claim 11 wherein a hollow cylindrical member extends from said lower radome member so as to function as an embedded plastic connector for the PIFA.

13. The PIFA of claim 12 wherein said hollow cylindrical member has longitudinally extending slots formed therein.

14. The PIFA of claim 12 wherein said base of said lower radome member has an opening formed therein for receiving said feed pin.

15. The PIFA of claim 14 wherein the center of said opening on said disc-shaped portion, the center of said opening in said base portion of said lower radome member, and the center of said hollow cylindrical member lie along a common vertical axis.

16. The PIFA of claim 15 wherein said base portion of said lower radome member has an opening formed therein which receives said ground tab.

17. The PIFA of claim 16 wherein said opening which receives said ground tab is positioned so as to communicate with the interior of said hollow cylindrical member; said ground tab being in contact with said cylindrical member.

18. The PIFA of claim 17 wherein a ground tab extends through said hollow cylindrical member and is also in contact with the exterior surface thereof.

* * * * *